US011020989B2

(12) United States Patent
Kato et al.

(10) Patent No.: US 11,020,989 B2
(45) Date of Patent: Jun. 1, 2021

(54) ROLL PAPER STEERING DEVIVE, PRINTING APPARATUS AND METHOD FOR ASSEMBLING PRINTING ROLL PAPER STEERING DEVICE

(71) Applicant: SEIKO EPSON CORPORATION, Tokyo (JP)

(72) Inventors: Shigeki Kato, Suwa (JP); Tomoyuki Shiiya, Matsumoto (JP); Atsushi Miyasaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/800,481

(22) Filed: Feb. 25, 2020

(65) Prior Publication Data

US 2020/0269609 A1 Aug. 27, 2020

(30) Foreign Application Priority Data

Feb. 27, 2019 (JP) ..... JP2019-033650

(51) Int. Cl.
*B65H 16/02* (2006.01)
*B41J 11/00* (2006.01)

(52) U.S. Cl.
CPC ..... *B41J 11/0045* (2013.01); *B65H 2301/415013* (2013.01)

(58) Field of Classification Search
CPC ..... B41J 11/0045; B41J 15/04; B41J 15/046; B65H 16/02; B65H 18/02; B65H 2301/415013; B65H 2301/415085; B65H 2403/52; B65H 23/0326; B65H 23/26
See application file for complete search history.

(56) References Cited

U.S. PATENT DOCUMENTS 9,056,502 B2 * 6/2015 Imamura ..... B41J 13/02
2015/0077460 A1 3/2015 Imamura

FOREIGN PATENT DOCUMENTS

JP 2012-201490 10/2012
JP 2015-054782 3/2015

* cited by examiner

*Primary Examiner* — Huan H Tran
(74) *Attorney, Agent, or Firm* — Workman Nydegger

(57) ABSTRACT

A roll paper steering device includes a guide rail fixed to a main body frame, a guide engaged with the guide rail, a holding shaft fixing member supported by the guide rail via the guide, a roll paper holding unit including a roll shaft and mounted to the holding shaft fixing member, a movable member configured to adjustably mount to the holding shaft fixing member, a nut member that includes an internal thread portion that screws into the external thread portion and that is fixed to the main body frame in a posture where the axis of the external thread portion is parallel with the guide rail, a first adjustment unit configured to adjust the posture of the holding shaft fixing member, and a second adjustment unit configured to adjust the position at which the movable member.

5 Claims, 8 Drawing Sheets

ROLL PAPER STEERING DEVIVE, PRINTING APPARATUS AND METHOD FOR ASSEMBLING PRINTING ROLL PAPER STEERING DEVICE

The present application is based on, and claims priority from JP Application Serial Number 2019-033650, filed Feb. 27, 2019, the disclosure of which is hereby incorporated by reference herein in its entirety.

BACKGROUND

1. Technical Field

The present disclosure relates to a roll paper steering device, a printing apparatus including the roll paper steering device, and a method for assembling the roll paper steering device in which the roll paper steering device is mounted to a main body frame.

2. Related Art

JP-A-2015-54782 is a known document disclosing a roll paper steering device and a printing apparatus including the same. JP-A-2015-54782 describes a technique for correcting meandering of a conveyed recording medium by moving, namely, steering a roll paper holding unit in an axial direction according to a position of an end portion of the recording medium.

The roll paper holding unit described above includes a roll shaft, which is a component that directly supports the roll paper. The roll shaft has a base portion rotably and axially supported by a bearing portion and a tip portion that protrudes toward the roll paper. When the roll paper holding unit holds the roll paper, the roll paper is heavier closer to the tip of the roll shaft than the bearing portion of the roll shaft. As a result, the roll shaft may deform downward with the bearing portion as a reference point due to the weight of the roll paper, and this may impair horizontal accuracy of the roll shaft.

In view of the roll shaft deforming due to the weight of the roll paper, the roll paper holding unit may be slightly inclined and mounted to a target member to offset the deformation of the roll shaft. A drive mechanism that steers such a roll paper holding unit includes an external thread such as a ball screw that rotates by a motor, where the shaft direction of the external thread is arranged parallel with a linear guide rail.

However, when the roll paper holding unit is slightly inclined and mounted to the target member as described above, the shaft direction of the external screw deviates from the direction of the linear guide rail and the external screw and the linear guide rail are no longer parallel with each other. As a result, a problem occurs in which meandering is corrected less accurately.

JP-A-2015-54782 does not describe or suggest a problem caused by the above-mentioned deviation.

SUMMARY

The present disclosure for solving the above-described problem includes a linear guide rail fixed to a main body frame, a holding shaft fixing member that is guided by and movably supported by the linear guide rail, can swing in a vertical direction and along the linear guide rail and is mounted with a roll paper holding unit having a roll shaft, a movable member that holds a motor and an external thread portion that rotates by the motor and that is adjustably mounted to the holding shaft fixing portion, a nut member fixed to the main body frame in a posture so that an axis of the external thread portion is parallel with the linear guide rail, a first adjustment unit that causes the holding shaft fixing member to swing to an inclination where a tip of the roll shaft is positioned upward to adjust the posture of the holding shaft fixing member with respect to the main body frame, and a second adjustment unit configured to adjust the position at which the movable member is mounted to the holding shaft fixing member.

DESCRIPTION OF EXEMPLARY EMBODIMENTS

Figure 1:
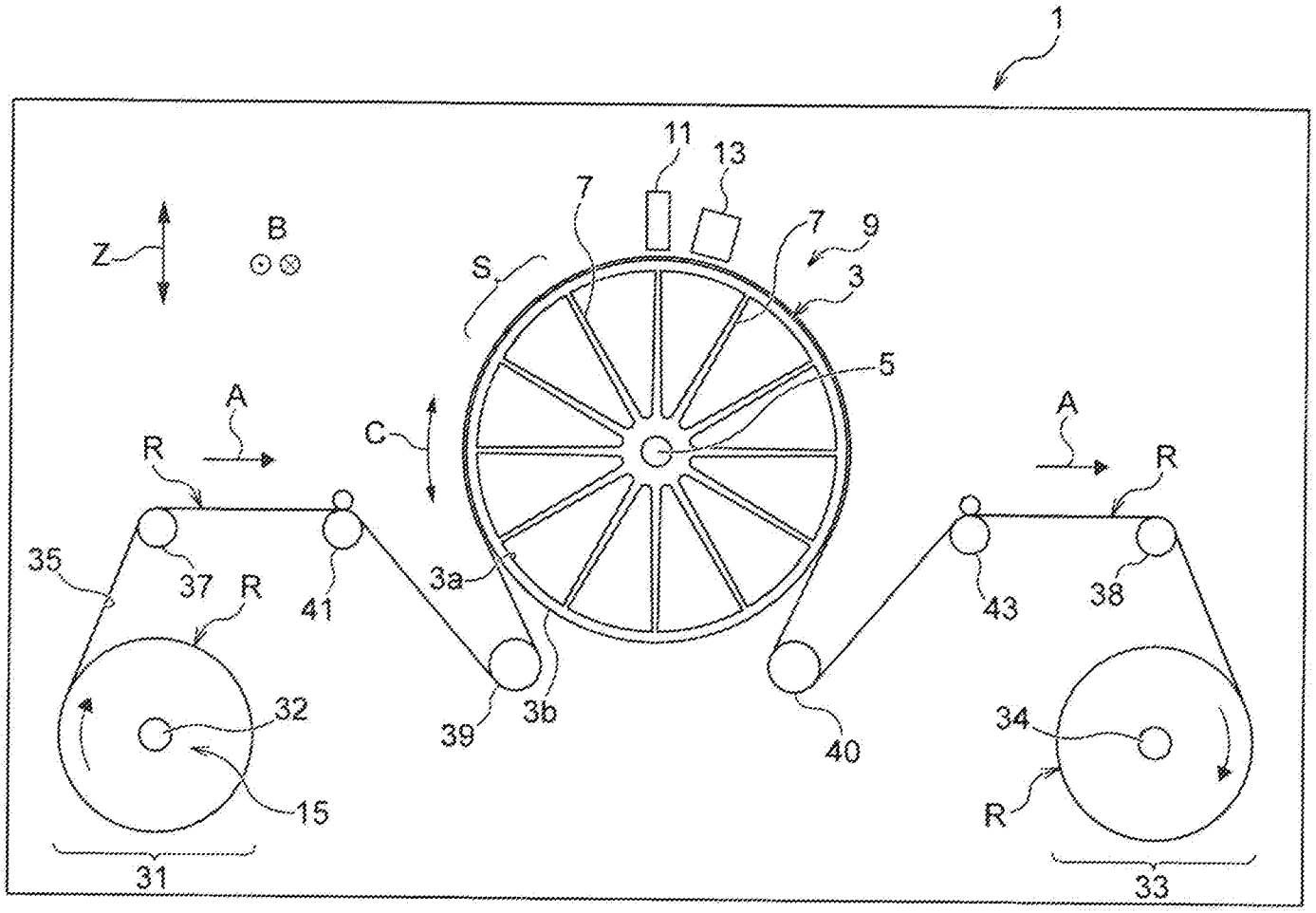
FIG. 1 is a side cross-sectional view schematically illustrating an overview of the overall configuration of a printing apparatus according to an embodiment of the present disclosure.

First, the present disclosure will be schematically described.

A roll paper steering device according to a first aspect of the present disclosure for solving the above-described problem includes a guide rail fixed to a main body frame, a guide engaged with the guide rail so as to be movable along the guide rail, a holding shaft fixing member supported by the guide rail via the guide, a roll paper holding unit including a roll shaft and mounted to the holding shaft fixing member, a movable member that holds a motor and an external thread portion that rotates by the motor and is adjustably mounted to the holding shaft fixing member, a nut member including an internal thread portion that receives the external thread portion, the nut member being fixed to the main body frame in a posture so that an axis of the external thread portion is parallel with the guide rail, a first adjustment unit that causes the holding shaft fixing member to swing to an inclination where a tip of the roll shaft is positioned upward, to thereby adjust the posture of the holding shaft fixing member with respect to the main body frame, and a second adjustment unit that adjusts the position at which the movable member is mounted to the holding shaft fixing member.

Herein, "roll paper" that is used in a "roll paper holding unit" or similar component is described using the term "roll paper", which is commonly used to refer to elongated material in sheet form wound into a roll shape. The material used as "roll paper" may be paper, or a cloth material such as a "resin film" or a "fabric".

According to this aspect, the position at which the movable member is mounted to the holding shaft fixing unit can be adjusted. Thus, even if the roll paper holding unit is slightly inclined and mounted to the mounting member and the external thread and the guide rail that make up the drive mechanism for steering are no longer parallel with each other, this deviation can be easily corrected.

A roll paper steering device according to a second aspect of the present disclosure is the roll paper steering device according to the first aspect, in which the second adjustment unit includes an abutted portion formed in the movable member, and an adjusting external thread that is inserted into a hole formed in the holding shaft fixing member and abuts against the abutted portion to adjust the position at which the movable member is mounted to the holding shaft fixing member.

According to this aspect, the second adjustment unit can be realized with a simple structure because the second adjustment unit consists of the abutted portion and the adjusting external thread.

A roll paper steering device according to a third aspect of the present disclosure is the roll paper steering device according to the first aspect or the second aspect, in which the first adjustment unit includes a swing fulcrum provided in the holding shaft fixing member, and causes the holding shaft fixing member to swing about the swing fulcrum to adjust the posture of the holding shaft fixing member with respect to the main body frame.

According to this aspect, the first adjustment unit can be realized with a simple structure.

A printing apparatus according to a fourth aspect of the present disclosure includes a feeding portion that feeds out roll paper set on a roll shaft toward a transport unit, and an ejecting unit that ejects liquid onto roll paper transported by the transport unit to form an image, in which the feeding portion includes the roll paper steering device of any one of the first to third aspects.

According to this aspect, the effect of any one of the first to third aspects can be obtained with a printing apparatus including a roll paper steering device.

A method for assembling a roll paper steering device according to a fifth aspect of the present disclosure is a method for assembling a roll paper steering device in which the roll paper steering device of any one of the first to third aspects is assembled to a main body frame in a state where mounting position and mounting angle of the roll paper steering device has been adjusted, the method including first adjustment assembly of fixing the guide to the holding shaft fixing member in a state where a mounting angle of the roll shaft has been adjusted using the first adjustment unit, and second adjustment assembly of fixing the movable member to the holding shaft fixing member in a state where an axis of the external thread portion for performing steering has been made parallel with an axis of the guide rail using the second adjustment unit, in which, after the guide is fixed to the holding shaft fixing member at a predetermined mounting angle in a posture where the holding shaft fixing member is guided to the guide rail via the guide in the first adjustment assembly, in the second adjustment assembly, the holding shaft fixing member is adjusted to a posture where the external thread portion is parallel with the guide rail and the movable member is fixed to the holding shaft fixing member at a predetermined mounting angle.

According to this aspect, the mounting angle of the roll shaft and the mounting position of the movable member for making the axis of the linear guide parallel with the axis of the external thread portion can be easily adjusted. As a result, the roll paper steering device can be easily assembled with high precision.

Now, the configuration of a roll paper steering device according to an embodiment of the present disclosure, the configuration of a printing apparatus according to an embodiment of the present disclosure, and a method for assembling the roll paper steering device will be described in detail with reference to the drawings.

Note that, in the following description, an outline of the overall configuration of the printing apparatus according to the present embodiment will be described first with reference to FIG. 1. Then, the configuration of the roll paper steering device, which is a main component of the present embodiment, will be described in detail with reference to FIGS. 2 to 8.

Next, the method for assembling the roll paper steering device, which is a main part of the present embodiment, will be described in detail based on FIG. 2 to FIG. 8 in order of steps of assembly.

Finally, operation and effects of the roll paper steering device and the method for assembling the printing apparatus and the roll paper steering device according to the present embodiment configured as described will be mentioned, followed by a brief description of other embodiments.

Embodiments

1. Outline of Entire Configuration of Printing Apparatus (see FIG. 1)

A printing apparatus 1 according to the present embodiment includes a feeding portion 31 configured to feed roll paper R set on a roll shaft 32 toward a transport unit 41, and an ejecting unit 11 configured to eject liquid onto the roll paper R transported by the transport unit 41 to form an image.

The feeding portion 31 is provided with a roll paper steering device 15, which will be described later.

The printing apparatus 1 illustrated in the drawings includes a rotary drum 9 having a cylindrical body 3, a rotary shaft 5, and a plurality of arm portions 7 that connect the rotary shaft 5 to an inner surface 3*a* of the cylindrical body 3. The arm portions 7 are spaced apart from each other in a circumferential direction C by a space S.

The feeding portion 31 is provided upstream in a transport direction A of the roll paper R. The feeding portion 31 supports the roll paper R due to the sheet-shaped roll paper R fed from the roll-shaped roll paper R mounted to the roll shaft 32 of the feeding portion 31 being wound around an outer surface 3*b* of the cylindrical body 3 of the rotary drum 9 at a predetermined winding angle.

UV ink in different colors as an example of liquid is ejected from the ejecting head 11 as an example of an ejecting unit onto the roll paper R that is wound around and supported by the outer surface 3*b* of the cylindrical body 3 of the rotary drum 9. Then, the roll paper R is irradiated with UV light from a UV irradiator 13 as an example of a curing unit to cure the UV ink ejected onto the surface of the roll paper R.

After the UV ink is ejected onto the surface of the roll paper R and the roll paper R is cured, the roll paper R reaches a winding unit 33 downstream in the transport direction A and is sequentially wound by a roll shaft 34 of the winding unit 33. Hereinafter, the roll paper R is continuously transported in a roll-to-roll transport manner while a desired image is printed on the roll paper R using the UV ink ejected from the ejecting head 11.

As an example, guide rollers 37, 38 and winding rollers 39, 40 configured of driven rollers, and transport rollers 41 and discharge rollers 43 as transport units made up of a pair of nip rollers including a driving roller and a driven roller are disposed partway down a transport path 35 of the roll paper R.

The roll paper steering device 15 according to the present embodiment acts as a supporting member for the roll shaft 32 in the feeding portion 31 and is configured to accurately correct meandering of the roll paper R fed from the feeding portion 31 by reciprocating within a predetermined stroke range with a roll paper width direction B as the steering direction with respect to a main body frame 2 of the printing apparatus 1.

2. Detailed Configuration of Roll Paper Steering Device (see FIGS. 2 to 8)

Next, the configuration of the roll paper steering device 15 according to the present embodiment applied to the feeding portion 31 of the printing apparatus 1 will be described in detail.

The roll paper steering device 15 includes a linear guide rail 17 fixed to the main body frame 2 (see FIG. 7), linear guides 19A, 19B engaged with the linear guide rail 17 so as to move in the steering direction along the linear guide rail 17, a holding shaft fixing member 23 supported by the linear guide rail 17 via the linear guides 19A, 19B, a roll paper holding unit 21 including the roll shaft 32 and mounted to the holding shaft fixing member 23, a movable member 27 holding a motor M1 and an external thread portion 25 that rotates by the motor M1 and being adjustably mounted to the holding shaft fixing member 23, and an internal thread portion 29 that receives the external thread portion 25. The roll paper steering device 15 also includes a nut member 30 fixed to the main body frame 2 with a bracket 61 in a posture so that an axis L1 of the external thread portion 25 is parallel with the linear guide rail 17, a first adjustment unit 45 that causes the holding shaft fixing member 23 to swing to an inclination where a tip 32*a* of the roll shaft 32 is positioned upward to adjust the posture of the holding shaft fixing member 23 with respect to the main body frame 2, and a second adjustment unit 47 that adjusts the position at which the movable member 27 is mounted to the holding shaft fixing member 23.

The linear guide rail 17 is a square bar-shaped member having an upper surface and a lower surface formed with grooves 18. The linear guide rail 17 is fixed to the main body frame 2 along the width direction B, which is the steering direction.

As an example, the two linear guides 19A, 19B are mounted to the linear guide rail 17 in a state where claw portions 20 that protrude so as to face inward are engaged with the grooves 18 in the linear guide rail 17.

The two linear guides 19A, 19B are screwed into the front surface of a holding shaft fixing plate 23 serving as the holding shaft fixing member after the angle at which the two linear guides 19A, 19B are mounted is adjusted using the first adjustment unit 45 described below.

Figure 2:
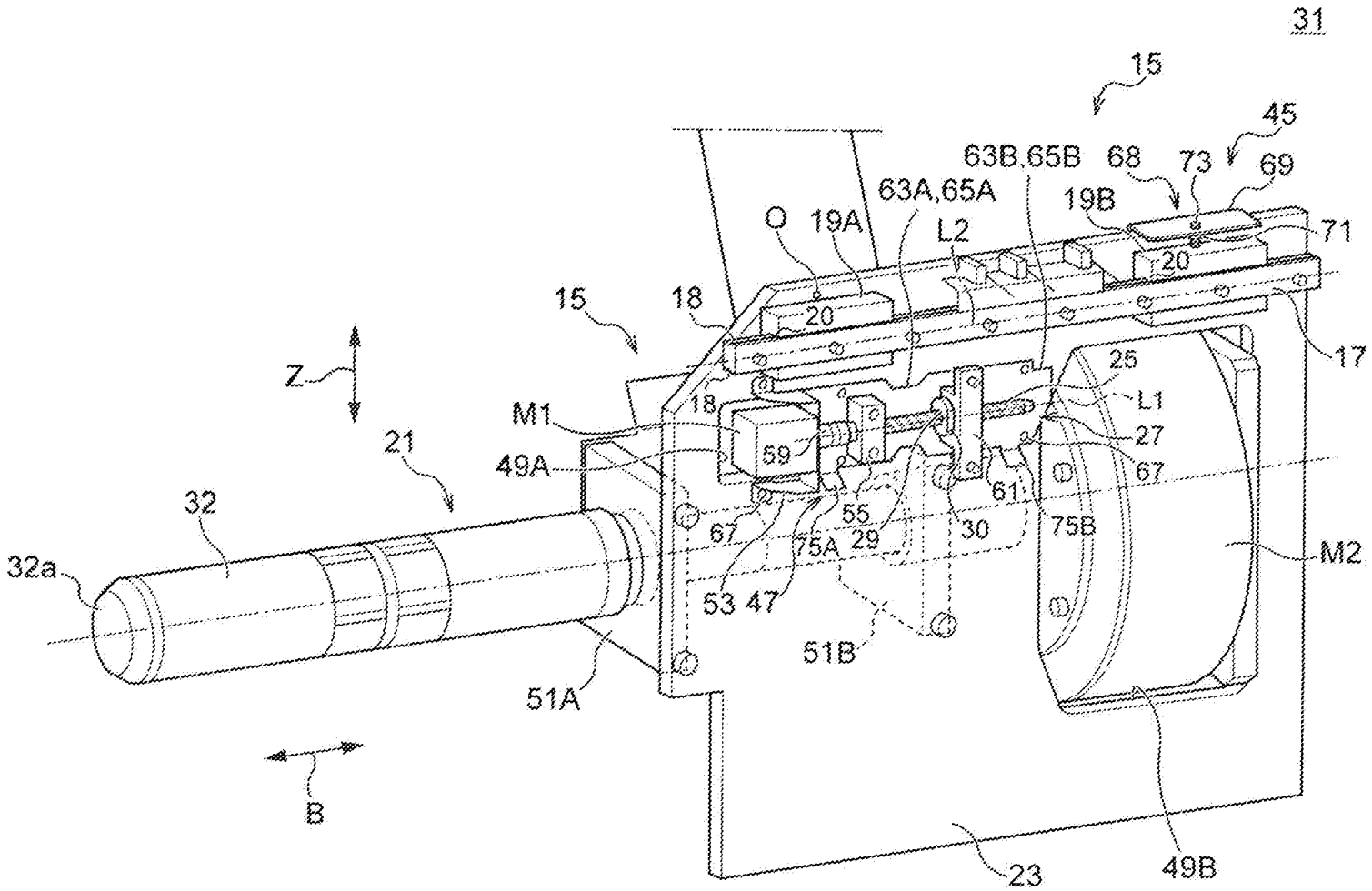
FIG. 2 is a perspective view illustrating a roll paper steering device according to an embodiment of the present disclosure.
Figure 3:
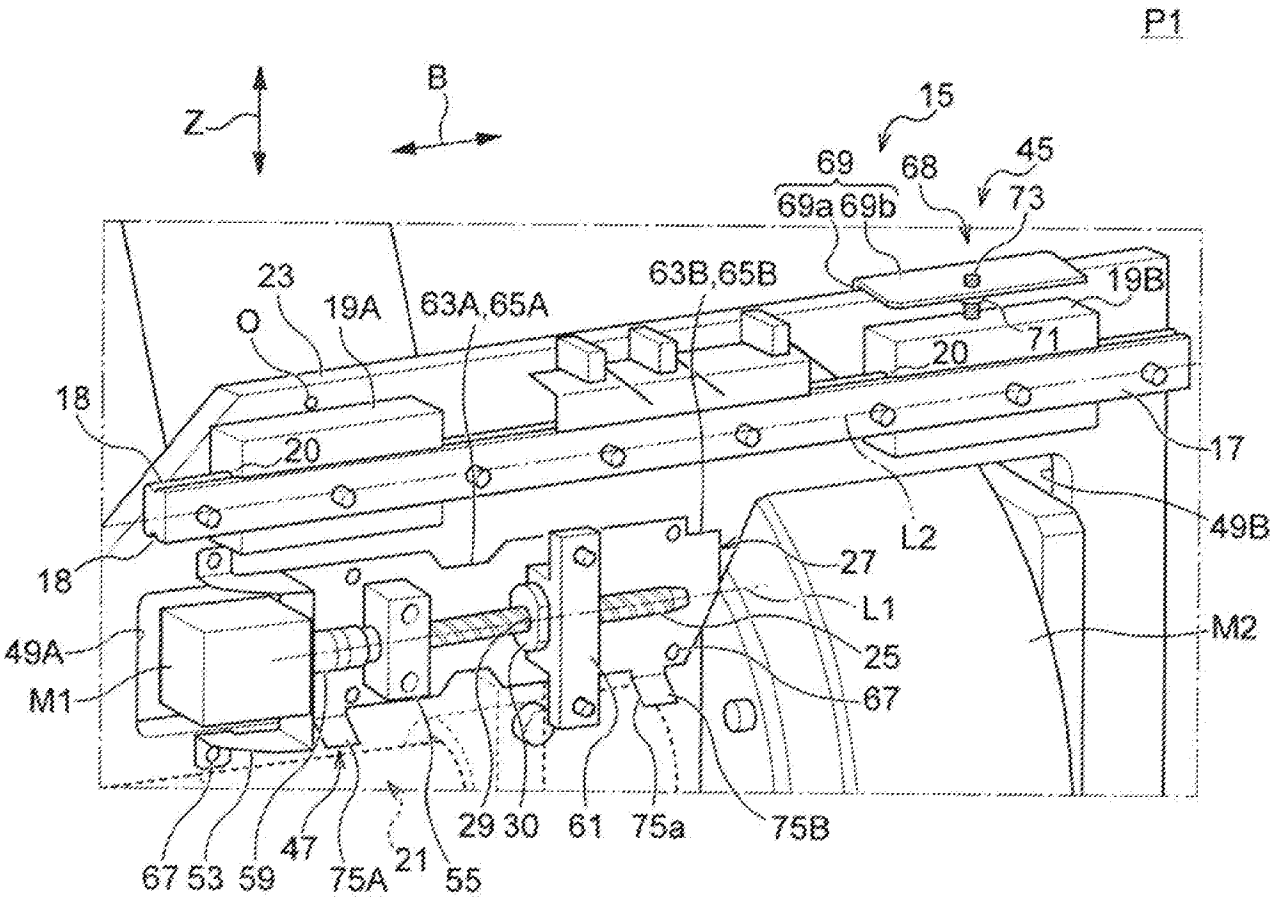
FIG. 3 is an enlarged perspective view illustrating a first main portion including a first adjustment unit and a swing fulcrum of the roll paper steering device according to an embodiment of the present disclosure.
Figure 4:
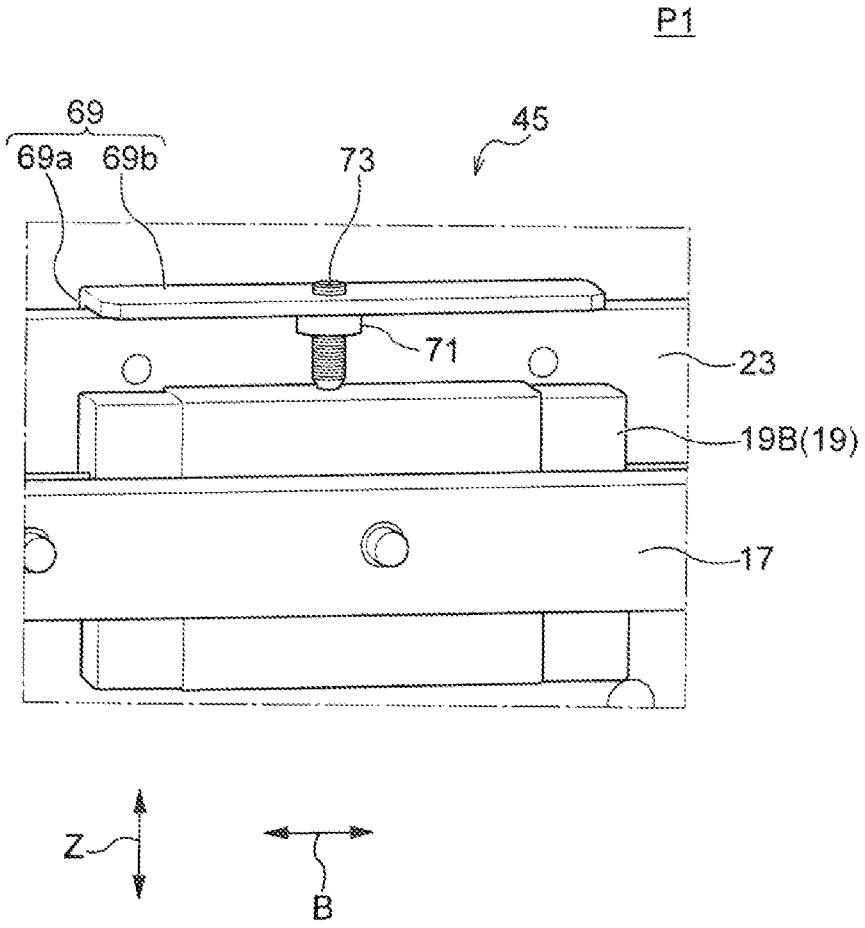
FIG. 4 is a further enlarged perspective view illustrating the first adjustment unit of the roll paper steering device according to an embodiment of the present disclosure.
Figure 5:
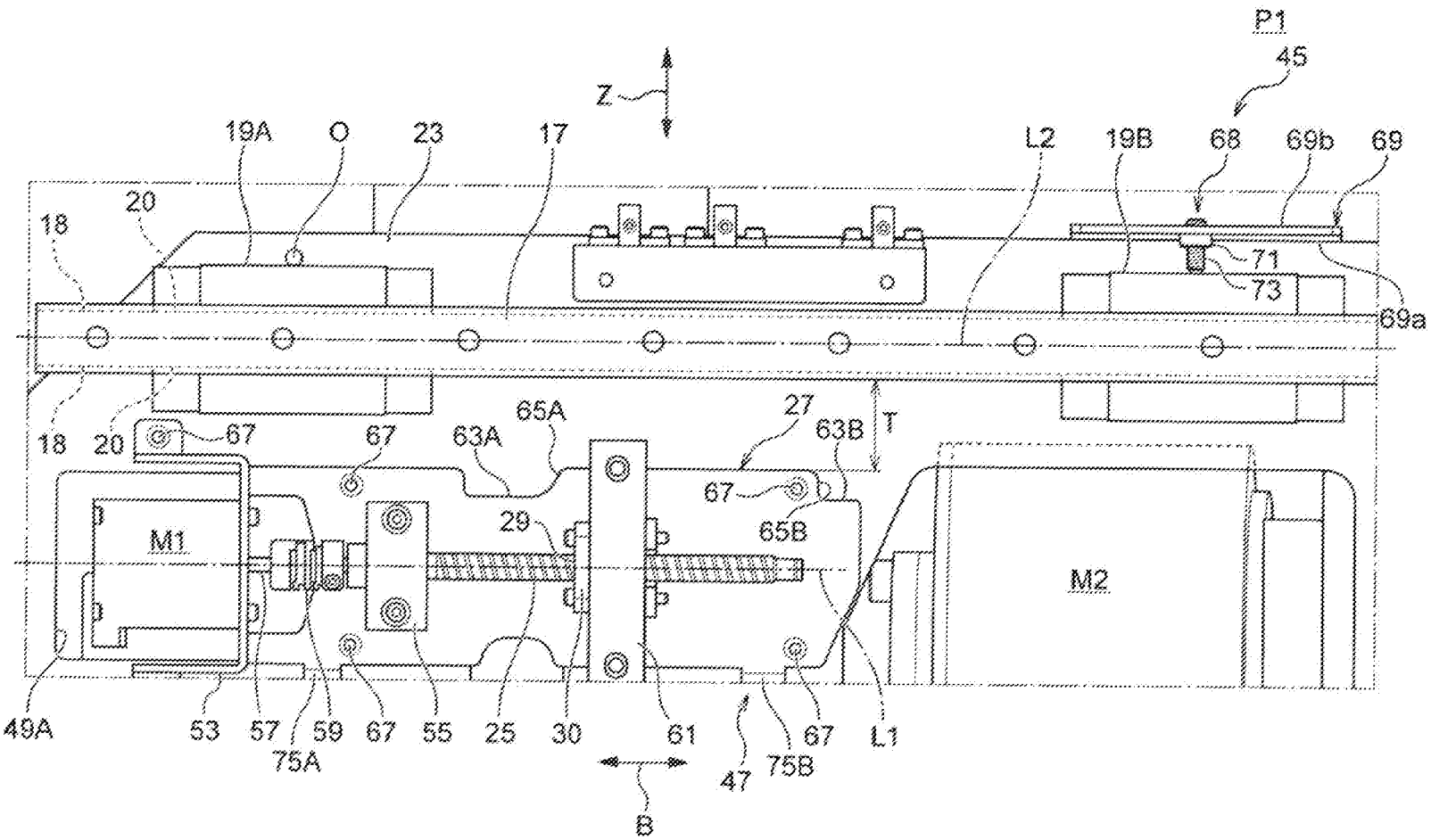
FIG. 5 is a front view illustrating the roll paper steering device according to an embodiment of the present disclosure in a posture where a linear guide rail and an external thread portion are parallel with each other.
Figure 6:
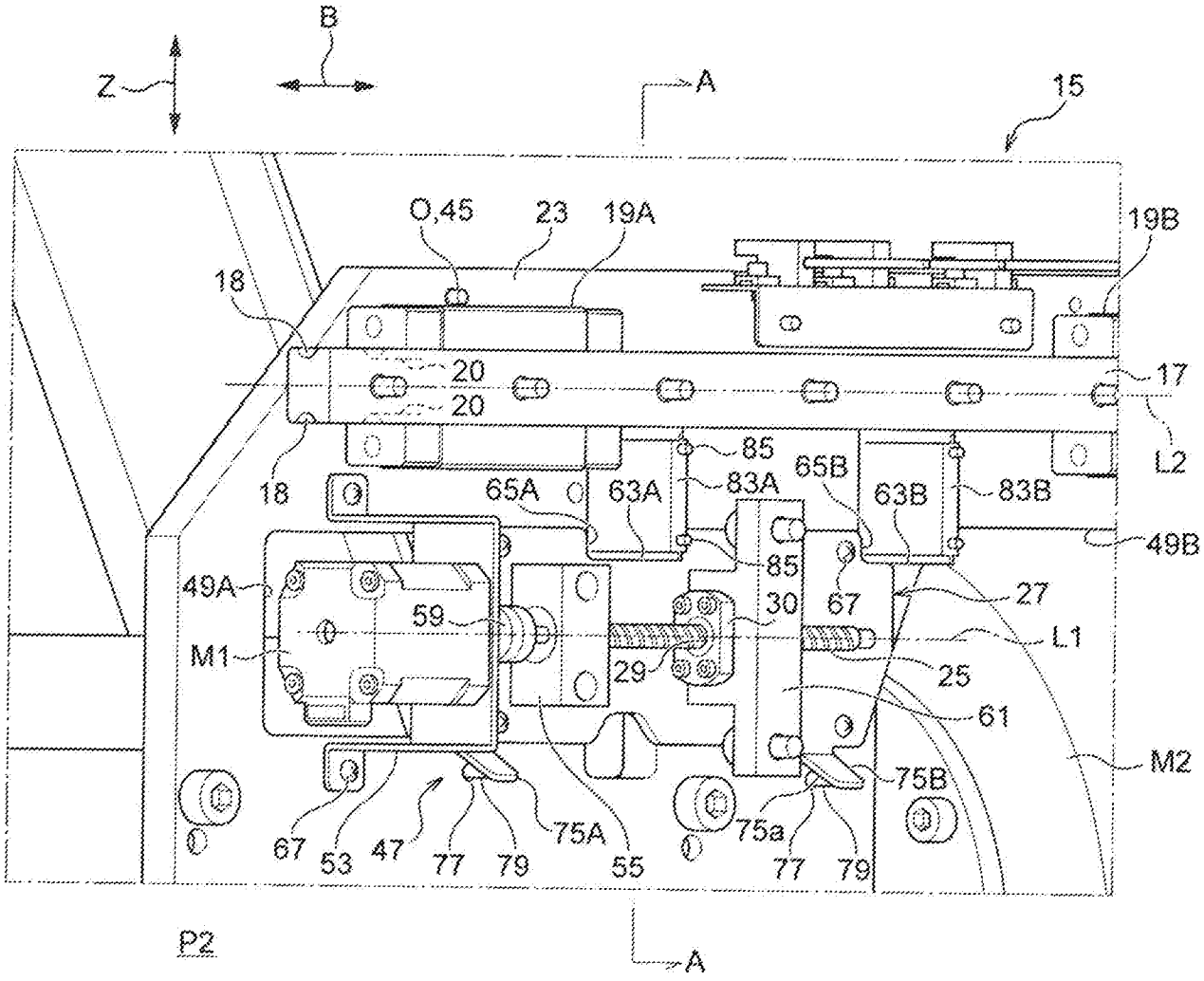
FIG. 6 is an enlarged perspective view illustrating a second main portion including a second adjustment unit of the roll paper steering device according to an embodiment of the present disclosure.
Figure 7:
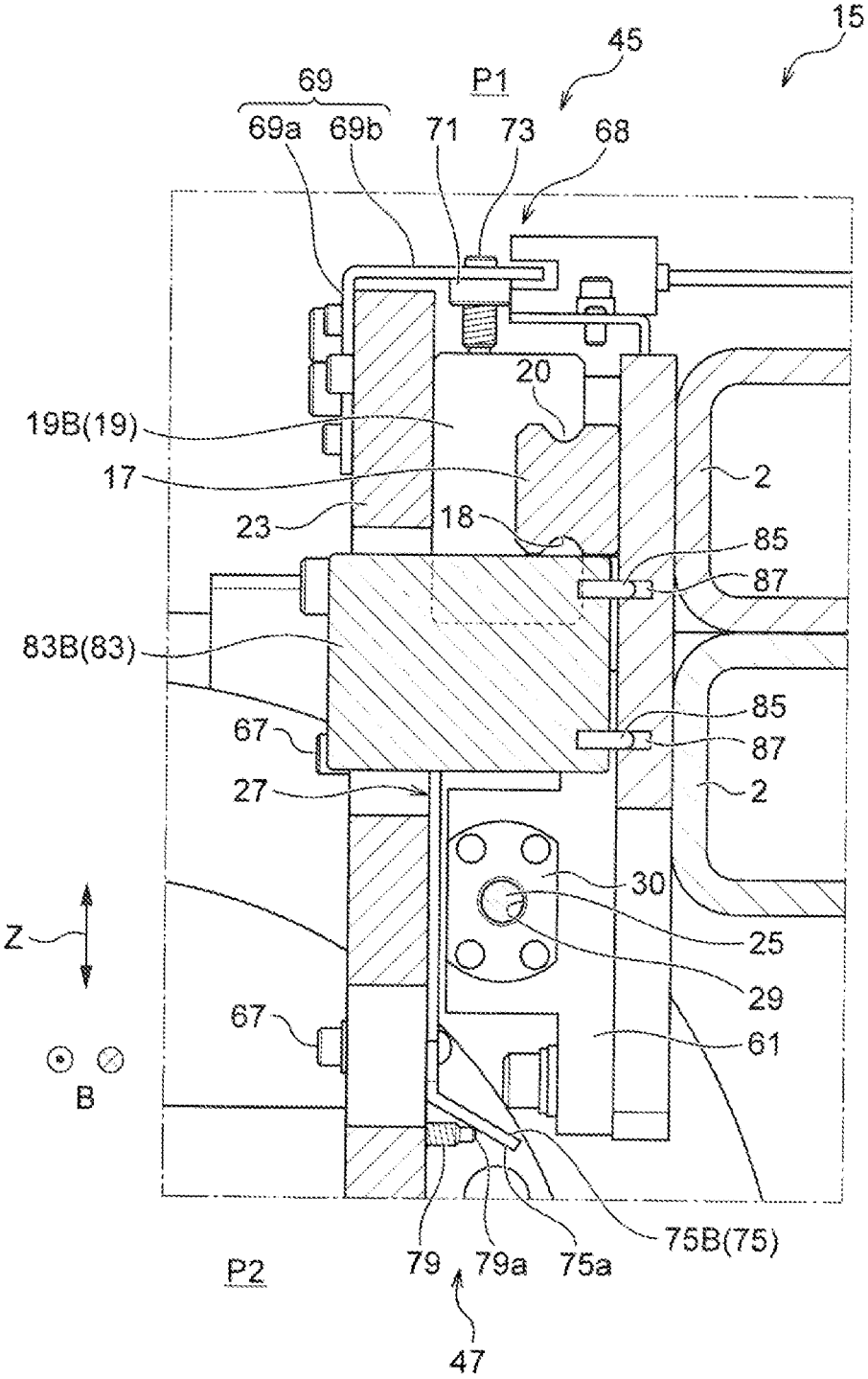
FIG. 7 is an enlarged cross-sectional view taken along A-A in FIG. 6 illustrating the second main portion including the second adjustment unit of the roll paper steering device according to an embodiment of the present disclosure.
Figure 8:
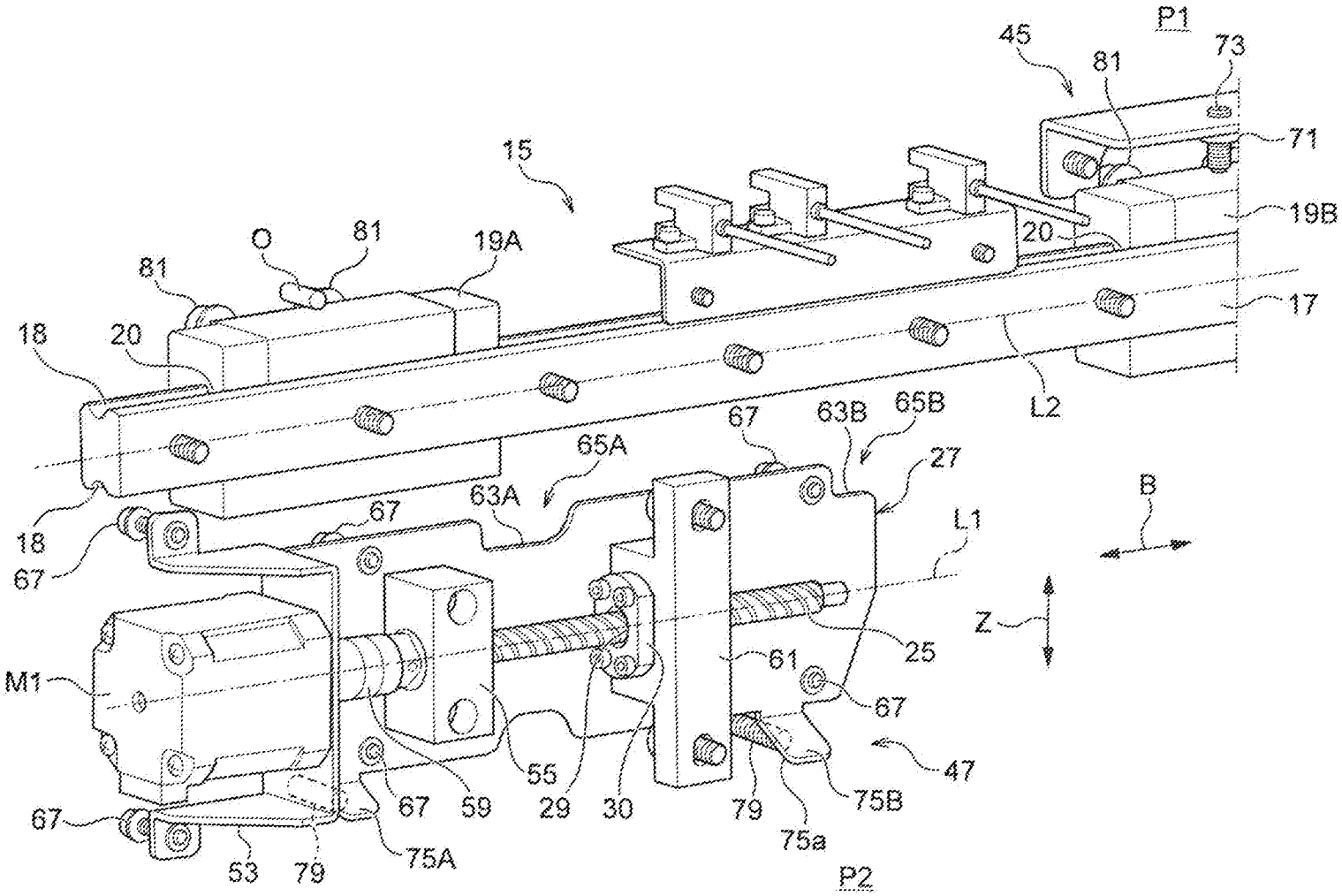
FIG. 8 is a perspective view illustrating only main components of the roll paper steering device according to an embodiment of the present disclosure.

As illustrated in FIG. 2, the holding shaft fixing plate 23 is a thick, substantially rectangular tabular member formed with two window portions 49A, 49B and is disposed in a vertical posture along a vertical direction Z. As illustrated in FIGS. 2, 3 and 5, the two linear guides 19A, 19B are mounted to left and right sides of the holding shaft fixing plate 23 near the upper end of the holding shaft fixing plate 23.

Further, the roll shaft 32 is horizontally supported on the rear face of the holding shaft fixing plate 23 through two bearing portions 51A, 51B. Note that a motor M2 that imparts driving force for feeding the roll paper R is provided directly on a base end portion of the roll shaft 32 and that the roll paper holding portion 21 is comprised of the roll shaft 32, the two bearing portions 51A, 51B and the motor M2.

Among the two window portions 49A, 49B formed in the holding shaft fixing plate 23, the window portion 49B has a larger aperture and is provided to avoid interference with the motor M2 of the roll paper holding unit 21.

The motor M1 that imparts driving force for performing a steering operation is disposed on a front face of the square window portion 49A, which has the smaller aperture of the two window portions 49A, 49B formed in the holding shaft fixing plate 23. Note that the motor M1 is mounted in a horizontal posture using a mounting bracket 53 formed by folding an end portion of the movable plate 27 forward. The movable plate 27 is to be described next.

The movable plate 27 serves as a movable member and is a thin, substantially rectangular tabular member that is long in the width direction B. A block-shaped bearing portion 55 is mounted to the front face of the movable plate 27 near the mounting bracket 53, and the base end portion of a ball screw 25, which is an example of an external thread portion, is supported by the bearing portion 55 in a cantilever state.

A coupling 59 is coupled to the base end portion of the ball screw 25. Power is transmitted from an output shaft 57 (see FIG. 5) of the motor M1, which is also coupled to the coupling 59, such that the ball screw 25 is configured to rotate in forward and reverse directions.

The internal thread portion 29 of the nut member 30 fixed to the main body frame 2 with the bracket 61 therebetween is screwed into the ball screw 25. When the ball screw 25 rotates, the ball screw 25 becomes integral with the motor M1 and the movable plate 27 while rotating and moves back and forth in the width direction B. Note that the nut member 30 remains in place without rotating because the nut member 30 is fixed to the main body frame 2.

The movable plate 27 is formed with two separation regulating portions 63A, 63B that are spaced apart in the width direction B so as to maintain a parallel interval T (see FIG. 5) from the linear guide rail 17. In the present embodiment, the separation regulating portions 63A, 63B are the bottom surfaces of two recessed portions 65A, 65B having a predetermined depth and formed downward from the upper end edge of the movable plate 27.

The position at which the movable plate 27 is mounted to the holding shaft fixing plate 23 is provided with play so as to be adjustable by a predetermined amount in the vertical direction Z and the width direction B. After the mounting position of the movable plate 27 is adjusted within this range of play, the movable plate 27 is fixed to the holding shaft fixing plate 23 using a lockscrew 67.

The positions at which the linear guides 19A, 19B are mounted to the holding shaft fixing plate 23 are also provided with play so as to be adjustable by a predetermined amount in the vertical direction Z and the width direction B. Then, the first adjustment unit 45 to be described next is adjusted. Through this adjustment, the relative positions of the left and right linear guides 19A, 19B change and the holding shaft fixing plate 23 swings about a swing fulcrum O so that the mounting angle of the roll shaft 32 can be set to an upward angle where the tip 32*a* faces upward by a predetermined amount.

The first adjustment unit 45 is made up of, for example, the swing fulcrum O provided on an upper portion of the holding shaft fixing plate 23 near the left end of the holding shaft fixing plate 23 and, for example, an adjustment operation unit 68 provided on an upper portion of the holding shaft fixing plate 23 near the right end of the holding shaft fixing plate 23.

When the adjustment operation unit 68 is operated, the holding shaft fixing plate 23 swings about the swing fulcrum O and the holding shaft fixing plate 23 can be adjusted to an inclination where the tip 32*a* of the roll shaft 32 fixed to the holding shaft fixing plate 23 is positioned upward.

The adjustment operation unit 68 is made up of, for example, an adjustment base plate 69 having an L-shaped cross section and including a back side plate 69*a* fixed to the back side of the holding shaft fixing plate 23 and an upper surface plate 69*b* bent forward into a peak, a nut portion 71 provided on a lower surface of the upper surface plate 69*b*, and an adjustment screw 73 that screws into the nut portion 71.

A lower end surface of the adjustment screw 73 abuts against the upper surface of the linear guide 19B on the right of the lower end surface. Rotating the adjustment screw 73 in the forward or reverse direction while the adjustment screw 73 abuts against the upper surface changes the protruding length of the protruding portion of the adjustment screw 73, which protrudes below the nut portion 71. Based on the length of the protruding portion, the holding shaft fixing plate 23 can be swung by a predetermined angle around the swing fulcrum O to adjust the mounting angle of the roll shaft 32 to a desired angle.

The second adjustment unit 47 is made up of an abutted portion 75 formed on the movable plate 27 and used for position adjustment, and an adjusting external thread 79 that is inserted into a hole 77 (see FIG. 6) formed in the holding shaft fixing plate 23 and adjusts the position at which the movable plate 27 is mounted to the holding shaft fixing plate 23 by abutting against the abutted portion 75.

The abutted portion 75 is made up of two inclined contact plates 75A, 75B provided so as to protrude from left and right lower end portions of the movable plate 27 toward obliquely forward lower portions of the movable plate 27. Two adjusting external threads 79 are provided. These threads 79 are screwed into internal thread portions formed on the inner wall of the hole 77. The two adjusting external threads 79 are made to protrude toward the front surface of the holding shaft fixing plate 23 such that tips 79*a* of the adjusting external threads 79 abut against inclined back surfaces 75*a* of the contact plates 75A, 75B. As a result, the two contact plates 75A, 75B can be individually pressed upward by a predetermined stroke, to thereby adjust the position at which the movable plate 27 is mounted to the holding shaft fixing plate 23.

3. Method for Assembling Roll Paper Steering Device (see FIGS. 2 to 8)

Next, a method for assembling the roll paper steering device in which the mounting position and mounting angle of the roll paper steering device 15 according to the present embodiment configured as described above are adjusted and the roll paper steering device 15 is assembled to the main body frame 2 of the printing apparatus 1 according to the present embodiment will be described in detail in order of the steps of assembly.

The method for assembling a roll paper steering device according the present embodiment includes a first adjustment assembly step P1 for adjusting the mounting angle of the roll shaft 32, and a second adjustment attaching step P2 for adjusting the mounting position of the movable plate 27. The first adjustment assembly step P1 is a step in which the linear guides 19A, 19B are fixed to the holding shaft fixing plate 23 at a predetermined mounting angle in a posture where the holding shaft fixing plate 23 is guided to the linear guide rail 17 via the linear guides 19A, 19B. After performing the first adjustment assembly step P1, in the second adjustment assembly step P2, the ball screw 25 is adjusted to a posture parallel with the linear guide rail 17 and the movable plate 27 is fixed to the holding shaft fixing plate 23 at a predetermined mounting position.

A. First Adjustment Assembly Step (see FIGS. 2 to 5)

The first adjustment assembly step P1 is a step for fixing the linear guides 19A, 19B to the holding shaft fixing plate 23 in a state where the mounting angle of the roll shaft 32 has been adjusted using the first adjustment unit 45. More specifically, lockscrews 81 (see FIG. 8) that fix the linear guides 19A, 19B to the holding shaft fixing plate 23 (see FIG. 8) are loosened in advance to create a state where the mounting positions of the linear guides 19A, 19B can be freely adjusted. When the adjustment screw 73 is rotated in the reverse direction in this state, the lower end surface of the adjustment screw 73 at the portion protruding below the nut portion 71 moves in a direction separating from the upper surface of the linear guide 19B on the right of the lower end surface. Here, the heavy motor M2 is fixed to the right side of the holding shaft fixing plate 23 below the linear guide 19B and, in a state where the holding shaft fixing plate 23 is not fixed to the linear guides 19A, 19B, the lower end surface of the adjustment screw 73 moves toward a direction separating from the upper surface of the linear guide 19B due to force that causes the holding shaft fixing plate 23 to rotate clockwise in FIG. 5 about the swing fulcrum. When this happens, the holding shaft fixing plate 23 follows the movement of the adjustment screw 73 and rotates clockwise by the distance moved by the adjustment screw 73.

As a result, the roll shaft 32 fixed to the holding shaft fixing plate 23 via the bearing portions 51A, 51B transitions to an inclined posture in which the tip 32*a* is positioned slightly upward. Then, after the mounting angle of the roll shaft 32 has been changed to a predetermined angle by adjusting the tightness of the adjustment screw 73, the lockscrews 81 are tightened to fix the linear guides 19A, 19B to the holding shaft fixing plate 23.

B. Second Adjustment Assembly Step (See FIGS. 6 to 8)

The second adjustment assembly step P2 is a step in which the movable plate 27 is fixed to the holding shaft fixing plate 23 in a state where the axis L1 of the ball screw 25 for performing steering is made parallel with an axis L2 of the linear guide rail 17 using the second adjustment unit 47.

More specifically, the lockscrew 67 used to fix the movable plate 27 to the holding shaft fixing plate 23 is loosened in advance to create a state where the mounting position of the movable plate 27 can be freely adjusted. Then, for example, upper end portions of thick, rectangular tabular-shaped adjustment jigs 83A, 83B are fitted into the lower surface of the linear guide rail 17 that faces the two recesses 65A, 65B formed in the upper portion of the movable plate 27. A pair of top and bottom positioning pins 85 is provided on the front face of each of the adjustment jigs 83A, 83B.

These positioning pins 85 are inserted into positioning holes 87 (see FIG. 7) formed in the main body frame 2 to position the adjustment jigs 83.

After completing this preparation operation, the tips 79*a* of the adjusting external threads 79 are made to abut against the inclined rear face 75*a* of the contact plate 75 integral with the movable plate 27.

When the adjusting external threads 79 are further tightened, an upward force is applied to the contact plate 75, allowing the movable plate 27 integral with the contact plate 75 to move upward by a predetermined distance.

When the separation regulating portions 63A, 63B as the bottom surfaces of the two recesses 65A, 65B in the movable plate 27 abut against lower end portions of the two adjustment jigs 83A, 83B, the movable plate 27 is restricted from moving further upward. In this state, the lockscrew 67 is tightened to fix the movable plate 27 to the holding shaft fixing plate 23.

After fixing the movable plate 27, the series of operations for assembling the roll paper steering device 15 is complete when the adjustment jigs 83A, 83B are removed by pulling out the adjustment jigs 83A, 83B behind the rear face of the holding shaft fixing plate 23. Note that FIGS. 1 to 5 do not illustrate the structural portion in which the adjustment jigs 83A, 83B are removed by being pulled out behind the rear face of the holding shaft fixing plate 23.

With the roll paper steering device 15 according to the present embodiment configured as described above, because the tip 32*a* of the roll shaft 32 can be biased slightly upward, the horizontal state of the roll shaft 32 can be maintained even when heavy roll paper R is attached to and set on the roll shaft 32. In addition, the axis L1 of the ball screw 25 and the axis L2 of the linear guide rail 17 can be kept parallel with each other, resulting in smoother steering performed when the ball screw 25 rotates and therefore a highly-accurate steering operation.

With the printing apparatus 1 according to the present embodiment configured as described above, the roll paper R can be transported in a state where meandering of the roll paper R fed out from the feeding portion 31 has been corrected with high accuracy due to the smooth and highly precise steering operation performed by the roll paper steering device 15. As a result, the quality of the image printed on the roll paper R can be improved. In addition, transportation problems such as blockage of the roll paper R caused by meandering of the roll paper R can be reduced.

With the method for assembling a roll paper steering device according to the present embodiment configured as described above, the mounting angle of the roll shaft 32 and the mounting position of the movable plate 27 for making the axis L2 of the linear guide 17 parallel with the axis L1 of the ball screw 25 can be easily adjusted. As a result, the roll paper steering device 15 can be easily assembled with high precision.

Other Exemplary Embodiments

The roll paper steering device 15 and the method for assembling the printing apparatus 1 and the roll paper steering device 15 according to the present disclosure have the configurations and components as described above, but it goes without saying that parts of these configurations may be changed or omitted without departing from the gist of the disclosure of the present application.

For example, the roll paper steering device 15 according to the present disclosure can be applied to the winding unit 33 in addition to the feeding portion 31 of the printing apparatus 1. Furthermore, the roll paper steering device 15 according to the present disclosure is not limited to the printing apparatus 1, and can be applied to other portions or devices that perform a shaft adjustment operation.

The external thread portion 25 in the roll paper holding unit 21 is not limited to the ball screw 25 and may be a screw with another structure, such as a trapezoidal screw. In addition, the holding shaft fixing member 23 and the movable member 27 do not necessarily need to be plate-like members and may have another structure, such as a block-shaped structure or a frame structure.

While one adjustment screw 73 used in the first adjustment unit 45 is provided for one linear guide 19, a plurality of, for example, two adjustment screws 73 may be provided. In a configuration where two adjustment screws 73 are provided at positions spaced apart from each other, the adjustment screws 73 correct the inclination of the linear guide 19 when the linear guide 19 is inclined. As a result, the surface at which the linear guide 19 abuts against the linear guide rail 17 becomes parallel with the linear guide rail 17 and the linear guide rail 17 can be held more reliably.

In addition, there is a condition that movement of the movable plate 27 in the steering direction not be hindered, but the movable plate 27 itself may be provided with a protruding portion or similar component that abuts against part of the linear guide rail 17 to fix the movable plate 27 to the holding shaft fixed plate 23 at a position where the tip of the protruding portion is in contact with the linear guide rail 17. When adopting such a configuration, the adjustment jig 83 need not be used in the second adjustment assembly step P2.

What is claimed is:

1. A roll paper steering device comprising:

a guide rail fixed to a main body frame;

a guide engaged with the guide rail so as to be movable along the guide rail;

a holding shaft fixing member supported by the guide rail via the guide;

a roll paper holding unit including a roll shaft and mounted to the holding shaft fixing member;

a movable member configured to hold a motor and an external thread portion that rotates by the motor and adjustably mounted to the holding shaft fixing member;

a nut member including an internal thread portion that receives the external thread portion, the nut member being fixed to the main body frame in a posture so that an axis of the external thread portion is parallel with the guide rail;

a first adjustment unit that causes the holding shaft fixing member to swing to an inclination where a tip of the roll shaft is positioned upward, to thereby adjust a posture of the holding shaft fixing member with respect to the main body frame; and a second adjustment unit configured to adjust a position at which the movable member is mounted to the holding shaft fixing member.

2. The roll paper steering device according to claim 1, wherein the second adjustment unit includes:

an abutted portion formed in the movable member; and an adjusting external thread that is inserted into a hole formed in the holding shaft fixing member and abuts against the abutted portion to adjust the position at which the movable member is mounted to the holding shaft fixing member.

3. The roll paper steering device according to claim 1, wherein:

the first adjustment unit includes a swing fulcrum provided in the holding shaft fixing member; and the first adjustment unit causes the holding shaft fixing member to swing about the swing fulcrum to adjust the posture of the holding shaft fixing member with respect to the main body frame.

4. A printing apparatus comprising:

a feeding portion configured to feed out roll paper set on a roll shaft toward a transport unit; and an ejecting unit configured to eject liquid onto roll paper transported by the transport unit to form an image, wherein the feeding portion includes the roll paper steering device according to claim 1.

5. A method of assembling a roll paper steering device for assembling the roll paper steering device according to claim 1 to a main body frame in a state where a mounting position and a mounting angle of the roll paper steering device are adjusted, the method comprising:

a first adjustment assembly step for fixing the guide to the holding shaft fixing member in a state where a mounting angle of the roll shaft is adjusted using the first adjustment unit; and a second adjustment assembly step for fixing the movable member to the holding shaft fixing member, in a state where an axis of the external thread portion for performing steering is parallel with an axis of the guide rail, using the second adjustment unit, wherein after the guide is fixed to the holding shaft fixing member at a predetermined mounting angle in a posture where the holding shaft fixing member is guided to the guide rail via the guide in the first adjustment assembly, the holding shaft fixing member is adjusted to a posture where the external thread portion is parallel with the guide rail and the movable member is fixed to the holding shaft fixing member at a predetermined mounting angle in the second adjustment assembly.

* * * * *